US006257100B1

(12) United States Patent
Tai

(10) Patent No.: US 6,257,100 B1
(45) **Date of Patent: *Jul. 10, 2001**

(54) ADJUSTABLE WRENCH

(76) Inventor: Daniel Tai, 4519 Hatch La., Lisle, IL (US) 60532-4360

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,166

(22) Filed: Feb. 4, 1999

(51) Int. Cl.[7] ..... B25B 13/22
(52) U.S. Cl. ..... 81/142; 7/139; 81/131
(58) Field of Search ..... 81/134, 142, 129, 81/129.5, 131, 3.42; 7/138, 139

(56) References Cited

U.S. PATENT DOCUMENTS 1,481,186 * 1/1924 Busch et al. ..... 81/134
1,643,002 * 9/1927 Beszczak ..... 81/134
2,000,962 * 5/1935 Krag ..... 7/139 X
2,186,430 * 1/1940 Richter ..... 7/139 X
2,448,815 * 9/1948 Mattocks ..... 81/3.42
3,625,096 * 12/1971 Myers ..... 81/129.5 X
4,454,791 * 6/1984 Seward ..... 81/142 X
5,313,860 * 5/1994 Liou ..... 7/138 X

* cited by examiner

*Primary Examiner*—James G. Smith
(74) *Attorney, Agent, or Firm*—Rosenberg, Klein & Lee

(57) ABSTRACT

An adjustable wrench is provided. The adjustable wrench comprising a grasping portion, an adjusting portion, and a positioning portion. The grasping portion is formed with a first wrench,opening clamp member. The adjusting portion is slidably coupled to the grasping portion which has formed therein positioning tooth. The adjusting portion is formed with a second wrench opening claim meter that opposes the first wrench opening clamp member. The positioning portion is pivotally connected to the adjusting portion and is pivotally displaceable into and out of a channel defined by the grasping portion. The positioning portion is also formed with a plurality of positioning teeth which engage the positioning teeth of the grasping portion when it is positioned within the channel. Rules indicative of one or more measurement scales are formed on side walls of the grasping portion such that the distance between the first and second wrench opening clamp members may be accurately measured.

7 Claims, 7 Drawing Sheets

ADJUSTABLE WRENCH

BACKGROUND OF THE INVENTION

FIELD OF THE INVENTION

The present invention relates to an adjustable wrench, and especially to a wrench structure having a large adjusting range and one that can be used conveniently.

PRIOR ART

Wrenches are a generally used tool for rotating a nut, a screw, and other parts. Prior art wrenches are adjustable wrenches (that is, movable wrenches), such as those disclosed in Taiwan Patent No. 251500, 257126, 274755, 302793, 304909, 308925, 310647, 312187, 312188, 340437, etc.

However, the prior art adjustable wrenches are rotative wrenches with a small adjusting range, have a control button located on the front end thereof and have a large volume. If the operating space is small, then such wrenches are inconvenient in operation. Moreover, such wrenches cannot be used to measure the size of a nut, and the user cannot preset a scale.

SUMMARY OF THE INVENTION

Accordingly, the object of the present invention is to provide an adjustable wrench including a grasping portion, an adjustable wrench and a positioning portion. By pushing the adjusting portion, the gap between two wrench engaging surfaces can be adjusted. Thus, it has a large adjusting range and a quick speed. The adjustment can be performed directly. A control button with a large volume is unnecessary, thus it is suitable for use in a small space.

Another object of the present invention is to provide an adjustable wrench wherein rules indicated with scales are installed on the outer walls of the grasping portion, and an indicator is installed on the positioning portion for indicating the scale of the grasping portion. Therefore, a size may be preset accurately and can be used to measure the size of a screw and a nut, so that the wrench can be used as a measuring tool.

The present invention will be better understood and its numerous objects and advantages will become apparent to those skilled in the art by referencing to the following drawings in which:

DETAILED DESCRIPTION OF THE PREFERRED EMBODIMENT

Figure 1:
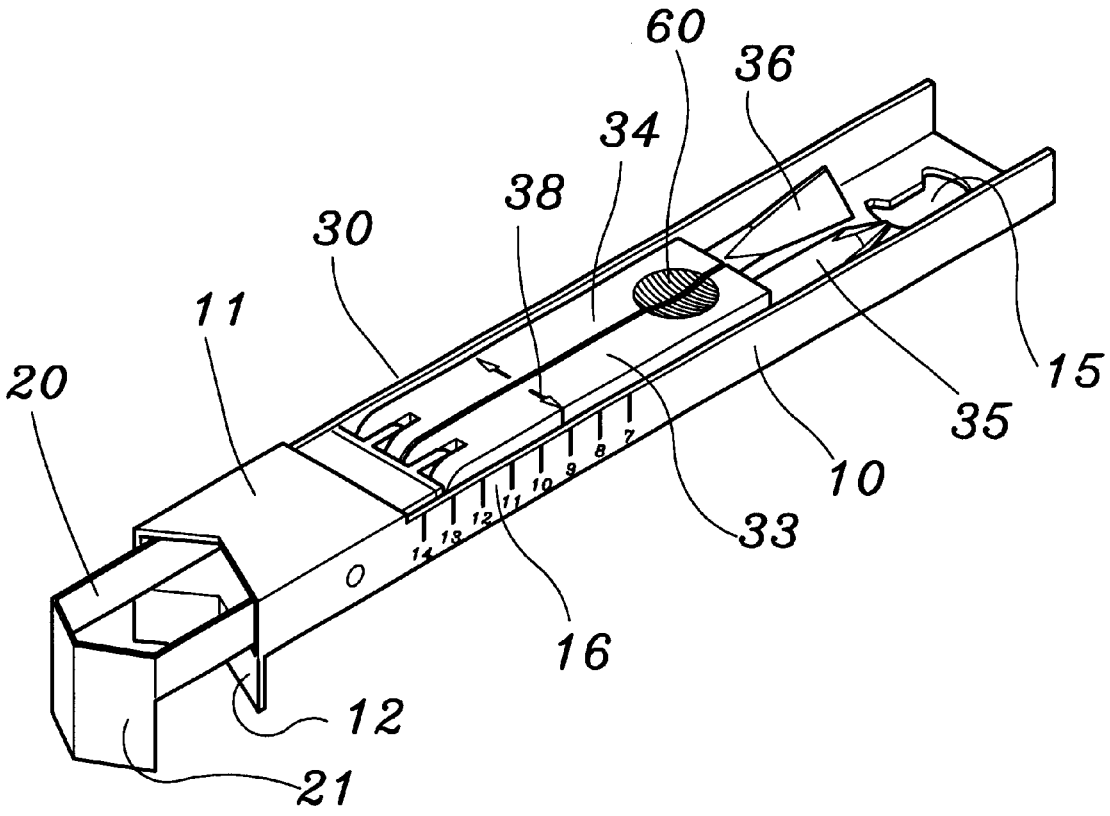
FIG. 1 is a perspective view of the present invention.
Figure 2:
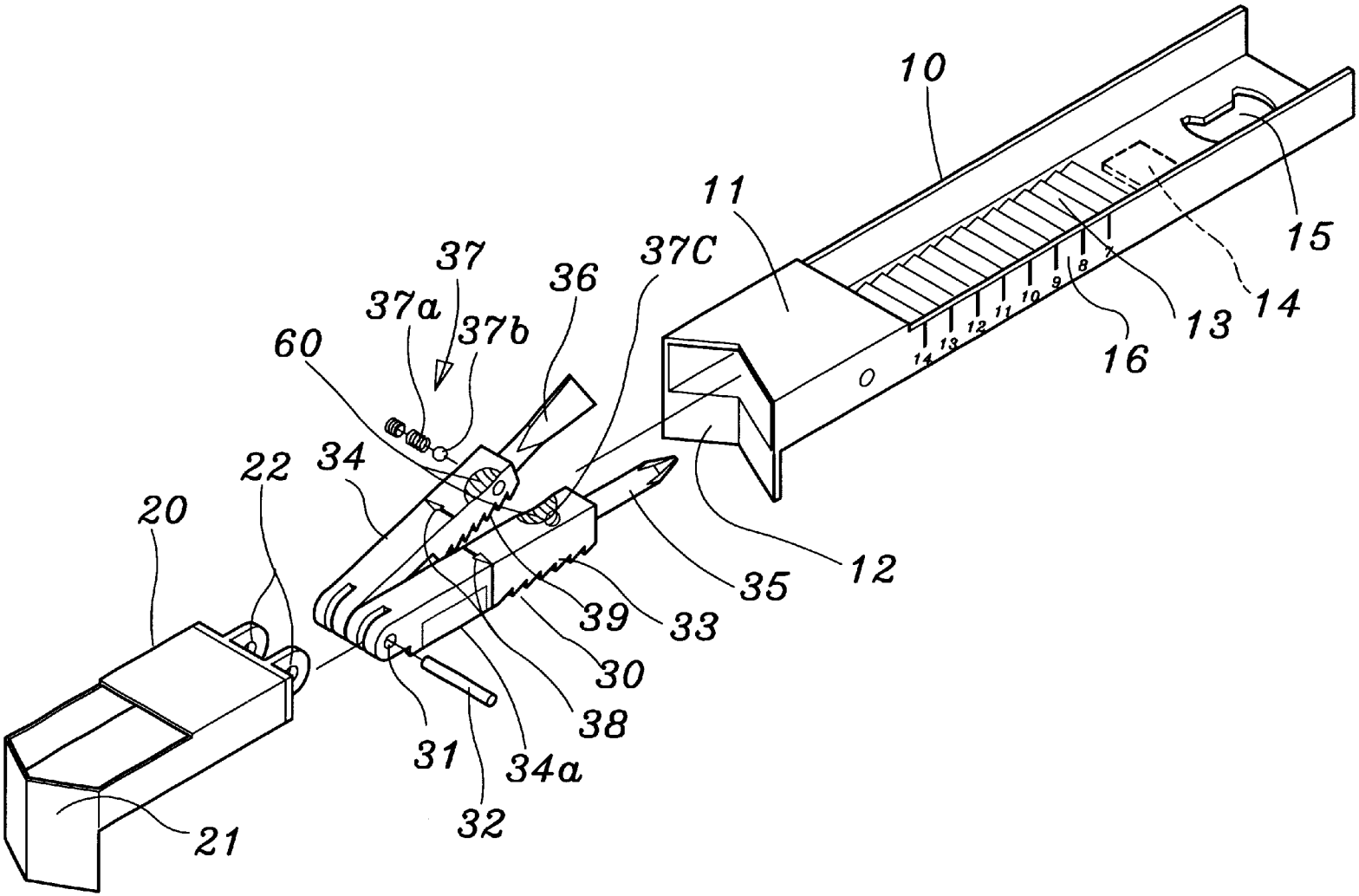
FIG. 2 is an exploded view of the present invention.
Figure 4:
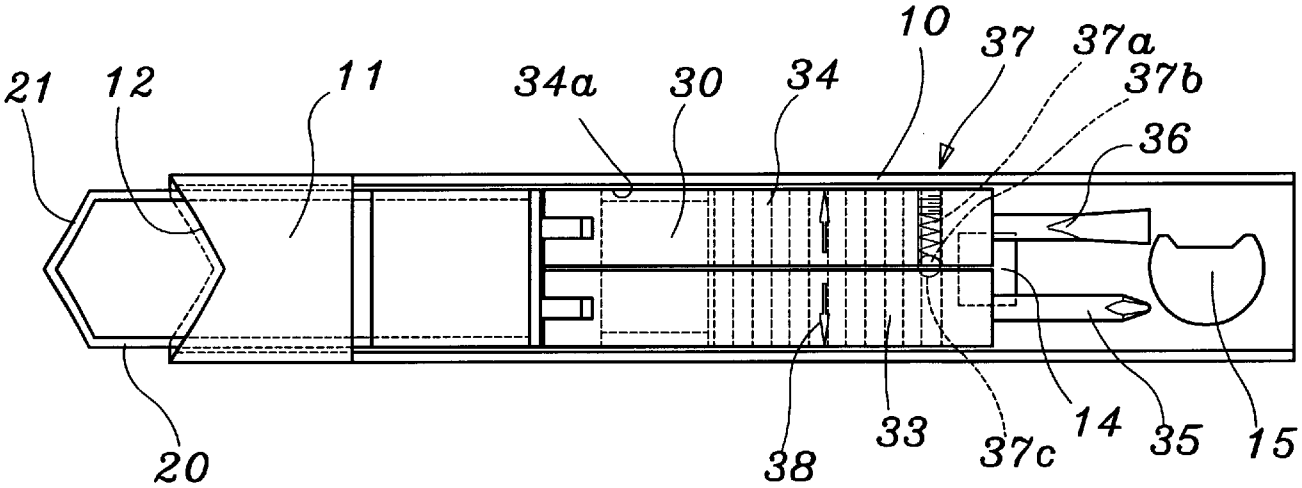
FIG. 4 is an elevation view of the present invention.
Figure 3:
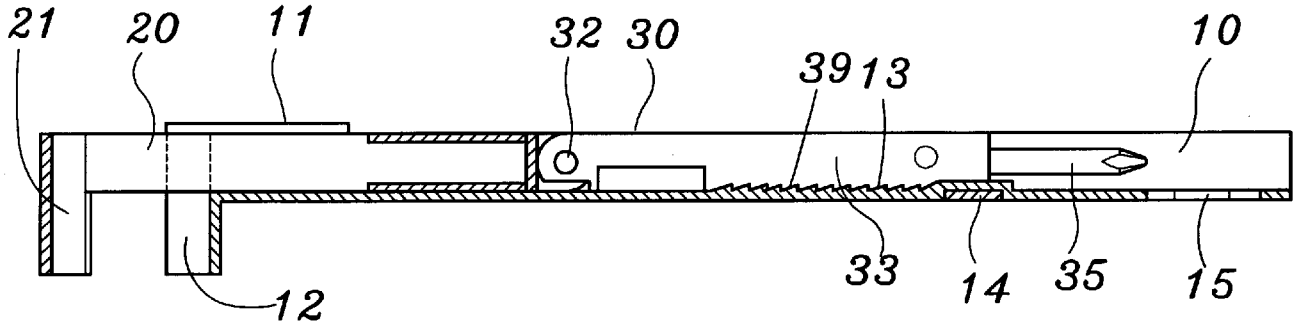
FIG. 3 is a front cross sectional view of the present invention.

As shown in FIGS. 1, 2, 3, and 4, the adjustable wrench of the present invention is illustrated. The adjustable wrench includes a grasping portion 10, an adjusting portion 20 and a positioning portion 30. The grasping portion 10 is a rod with a proper length and a bush 11. The front end of the grasping portion 10 has a first wrench engaging surface 12. A plurality of equally spaced positioning teeth 13 are installed on the inner wall of the bottom of the grasping portion 10. An opener mouth 15 is formed on the bottom of the grasping portion 10 near the rear end thereof. Rules 16 and 16*a* with scale indications are installed on the outer walls of the two sides of the grasping portion 10. The rules 16 and 16*a* are indicated with metric system and English system scales for contrasting one with the other.

The adjusting portion 20 is slidably arranged within the bush 11 of the grasping portion 10. The adjusting portion 20 can be moved forwards and backwards within the bush 11. The front end of the adjusting portion 20 has a second wrench engaging surface 21 which has an approximate V shape and is disposed in correspondence with the first wrench engaging surface 12 on the front end of the grasping portion 10. A pivot hole 22 is formed on the rear end of the adjusting portion 20.

A positioning portion hole 31 is formed on the front end of the positioning portion 30. A pivot shaft 32 matches with the pivot hole 31 on the front end of the positioning portion 30 and the pivot hole 22 on the rear end of the adjusting portion 20, thus the positioning portion 30 is pivotally connected to the rear end of the adjusting portion 20 so that the positioning portion 30 moves forwards and backwards within the grasping portion 10 with the adjusting portion 20. An indicator 38 is installed on the positioning portion 30 for indicating the rules 16 and 16*a* on the grasping portion 10 in order to indicate the sizes of the components (such as nut) clamped between the first wrench engaging surface 12 and second wrench engaging surface 21. The bottom of the positioning portion 30 is installed with a plurality of equally spaced positioning teeth 39. The positioning teeth 39 can engage with the positioning teeth 13 of the grasping portion 10. The positioning portion 30 can be divided into two bodies 33 and 34. Other tools 35 and 36 are installed on the rear end of the bodies 33 and 34. A resilient connecting means 37 is installed within the two bodies 33 and 34. A spring 37*a* and a steel ball 37*b* are installed within one body 34, and a connected hole 37*c* is installed within another body 33. When the two bodies tightly close with one another, spring 37*a* will bias the steel ball 37*b* to project outwards from the body 34 and into the connecting hole 37*c* of the other body 33 so that the two bodies 33 and 34 are combined by resilient biased locking means in order that the two bodies be operated together or separately. Additionally, a groove 60 can be installed on the top portion of the bodies 33 and 34 of the positioning portion 30. Thus, by the aforementioned structure, an adjustable wrench is formed.

Figure 9:
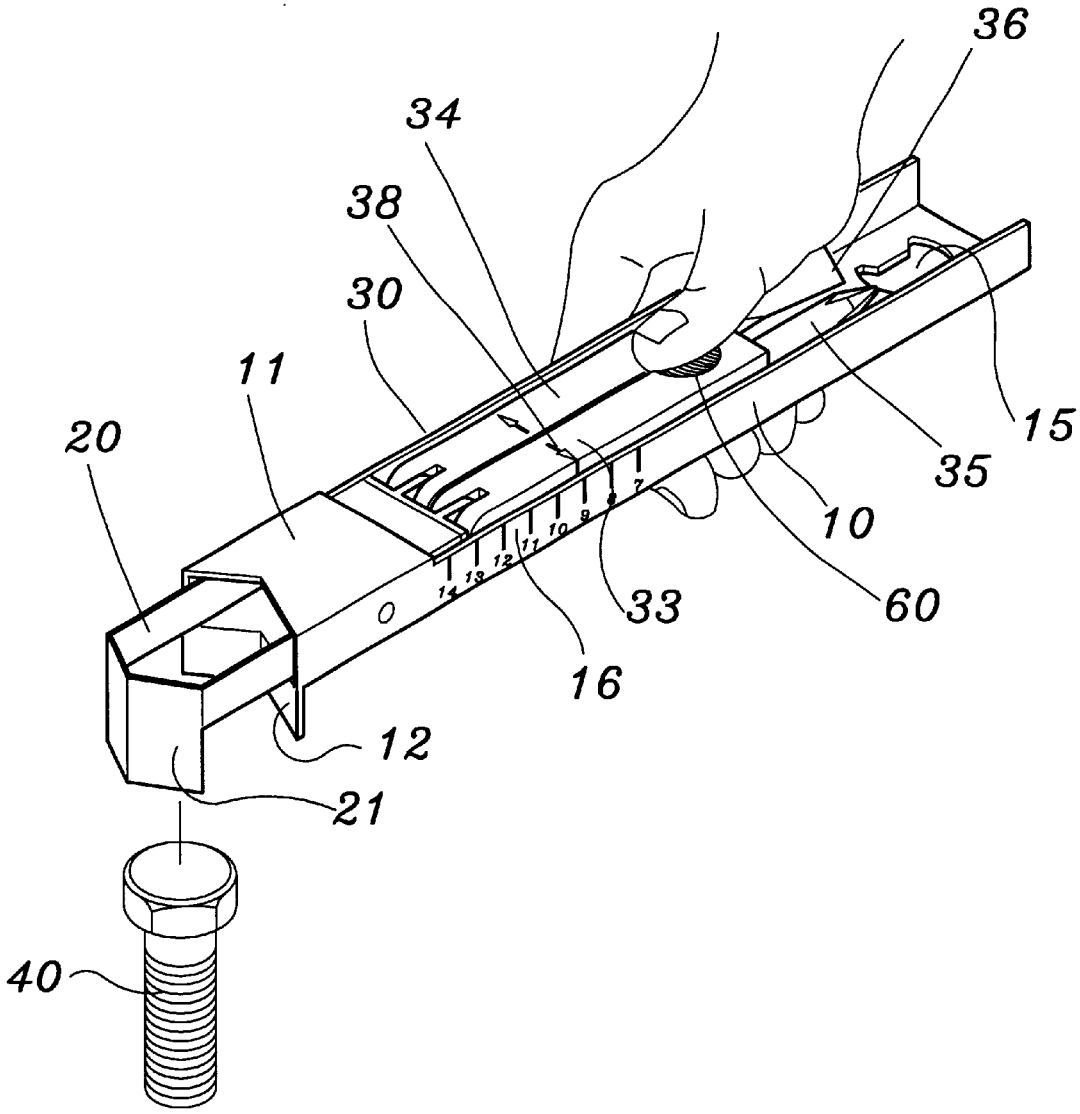
FIG. 9 is a schematic view showing a further using state of the present invention.

As shown in FIG. 9, when using the present invention, the thumb of the user can press on the groove 60 of the positioning portion 30 and the other four fingers hold the grasping portion 10 to dispose the first wrench engaging surface 12 of the grasping portion 10 and the second wrench engaging surface 21 of the adjusting portion 20 above the screw (nut). The user's thumb pulls the adjusting portion backwards so that the first wrench engaging surface 12 and the second wrench engaging surface 21 will clamp the screw 40 (nut), then the user's thumb presses the adjusting portion 20 backwards, so that after it is fixed, then the wrench can be rotated.

Figure 6:
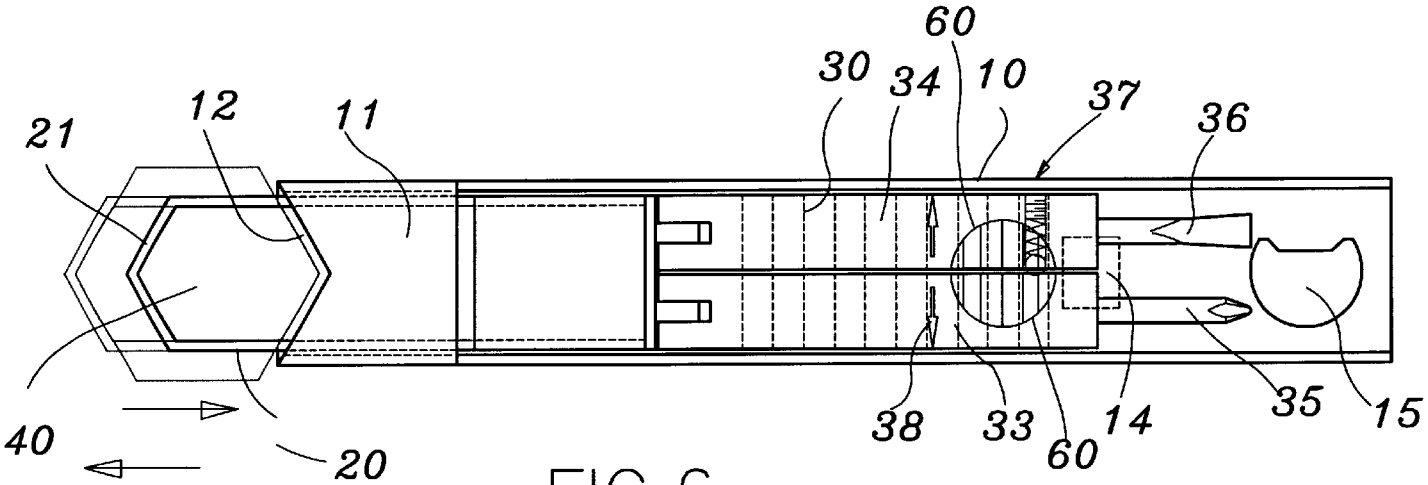
FIG. 6 is a schematic view showing another using state of the present invention.
Figure 5:
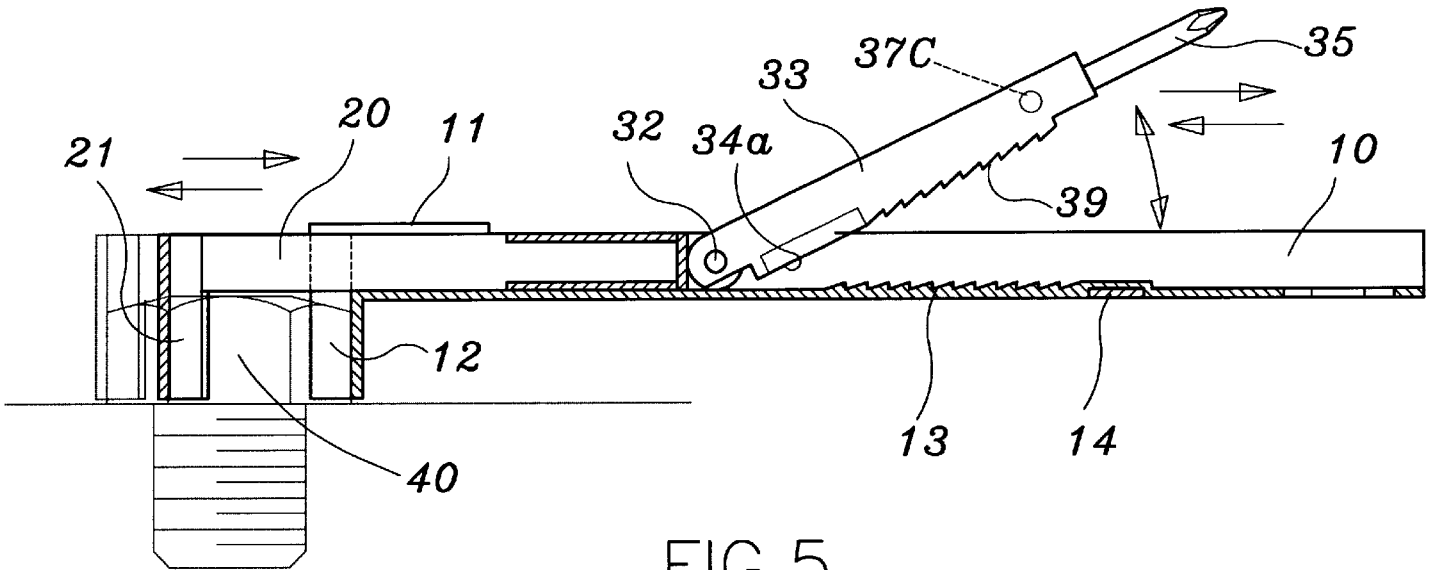
FIG. 5 is a schematic view showing a using state of the present invention.

As shown in FIGS. 5 and 6, by adjusting the adjusting portion 20 to move forwards and backwards adjusts the gap between the first wrench engaging surface 12 of the grasping portion 10 and the second wrench engaging surface 21 of the adjusting portion 20 so as to tightly clamp screws 40 or nuts of different sizes. After it is adjusted, the rear end of the positioning portion 30 can be pressed downwards so that the positioning teeth 39 of the positioning portion 30 and the positioning teeth 13 of the grasping portion 10 are engaged with one another. Therefore, the gap between the first wrench engaging surface 12 of the grasping potion 10 and the second wrench engaging surface 21 of the adjusting portion 20 is fixed. Thus, the two wrench engaging surfaces firmly clamp the screw 40. Thereafter, by moving the grasping portion 10, a force is applied to the screw 40. Further, the arrangement of the magnet 14 may be used to attract the positioning portion 30 so that the positioning teeth 39 and 13 are firmly engaged and the two bodies 33 and 34 will be combined together. Further, by the magnetic force, dropped screws and nuts can be picked up.

Figure 7:
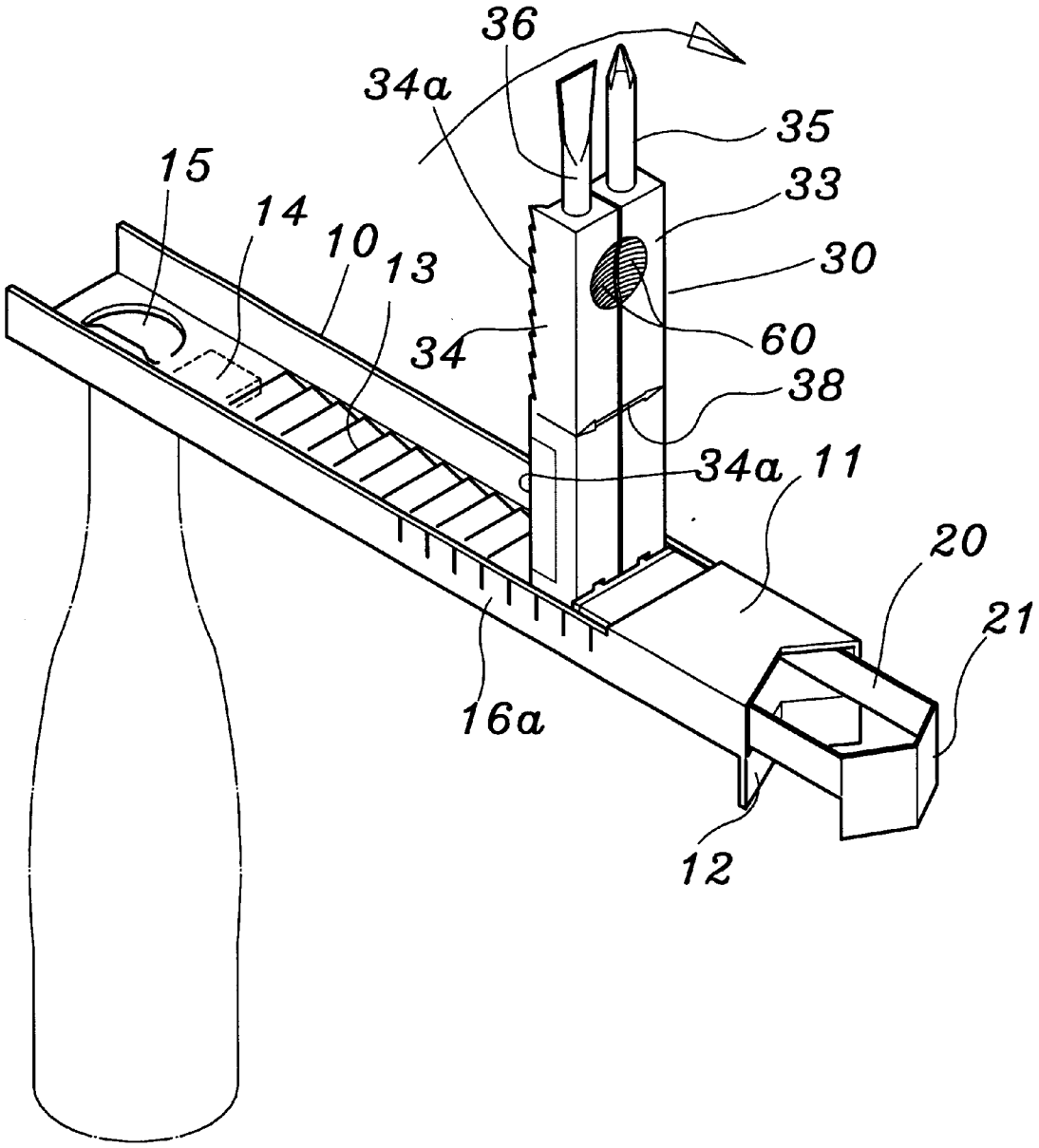
FIG. 7 is a schematic view showing a further using state of the present invention.
Figure 8:
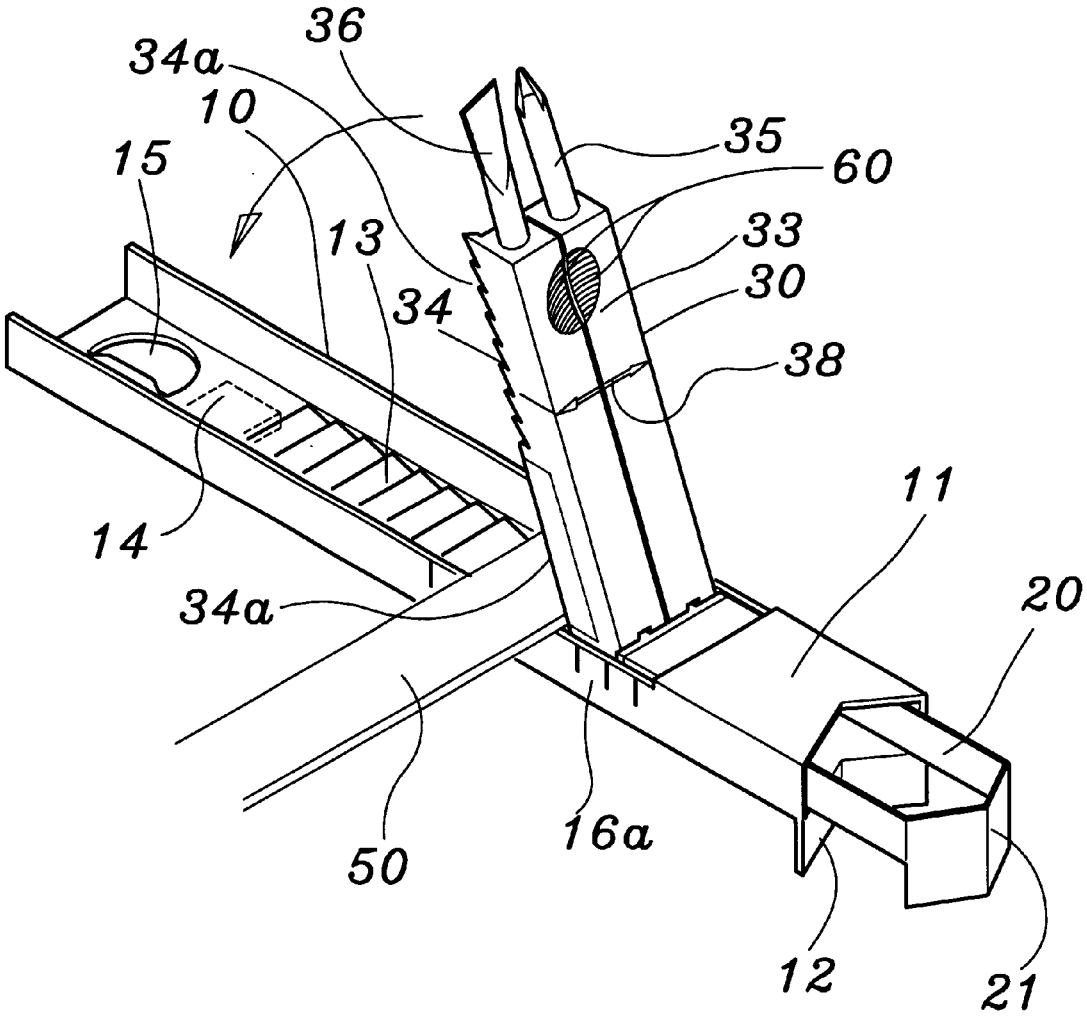
FIG. 8 is schematic view showing a further using state of the present invention.

As shown in FIG. 7, in the present invention, the opener mouth 15 of the grasping portion 10 serves as a bottle opener. In use, the positioning portion 30 is stood upright. Then, by moving the positioning portion 30 to move sidewards, the present invention serves to open a bottle cover. As shown in FIG. 8, in the present invention, the outer rim on the bottom of the body 34 of the positioning portion 30 can be formed as a knife 34a. The knife 34a can be used to cut an object 50 disposed between the grasping portion 10 and the positioning portion 30.

As described hereinbefore, the adjustable wrench of the present invention has the following advantages:

1. In the present invention, the positioning portion 20 serves to adjust the gap between two wrench engaging surfaces 12 and 21, thus, it has a larger adjusting range.
2. In the present invention, the adjusting portion 20 directly adjusts the gap and a control button with larger volume is unnecessary. Therefore, it is suitable to be used in a small space.
3. In the present invention, the indicator 38 serves to indicate the scales of the rules 16 and 16*a* on the grasping portion 10.
4. The present invention can be used to measure the size of nuts, screws (head portion), or can be used as a measuring tool for other things.
5. The present invention can be used as a bottle opener or wrench.

Therefore, from the aforementioned description, it is appreciated that the present invention has improved the defects in the prior art, such as a small adjusting range, a slow control button, inconvenience in smaller spaces, being without size measurement, etc.

Although the invention has been described in detail with reference only to a preferred embodiment, those skilled in the art will appreciate that various modifications can be made without departing from the invention. Accordingly, the invention is defined only by the following claims which are intended to embrace all equivalent thereof.

What is claimed is:

1. An adjustable wrench comprising:

(a) a grasping portion having front and rear end sections and an intermediate section extending longitudinally therebetween, said front end section having a first wrench engaging surface, said intermediate section including bottom and side surfaces defining a channel having a substantially U-shaped sectional contour, said bottom surface having formed thereon a plurality of teeth;

(b) an adjusting portion slidably coupled to said grasping portion, said adjusting portion having a second wrench engaging surface;

(c) a positioning portion pivotally coupled to said adjusting portion, said positioning portion being pivotally displaceable between first and second positions, said positioning portion being received within said channel in said first position, said positioning portion having a toothed segment formed on a bottom side thereof for engaging said bottom surface teeth of said grasping portion intermediate section when in said first position, whereby said adjusting portion is releasably locked in position relative to said grasping portion;

(d) at least one rule being formed on at least one of said side surfaces of said grasping portion intermediate section for indicating a measurement scale corresponding to a distance between said first and second wrench engaging surfaces; and, (e) an indicator formed on said positioning portion for indicative alignment with a marker of said rule.

2. The adjustable wrench as recited in claim 1 wherein said front end section of said grasping portion includes a bush structure slidably engaging said adjusting portion.

3. An adjustable wrench comprising:

(a) a grasping portion having front and rear end sections and an intermediate section extending longitudinally therebetween, said front end section having a first wrench engaging surface, said intermediate section including bottom and side surfaces defining a channel having a substantially U-shaped sectional contour, said bottom surface having formed thereon a plurality of teeth;

(b) an adjusting portion slidably coupled to said grasping portion, said adjusting portion having a second wrench engaging surface;

(c) a positioning portion pivotally coupled to said adjusting portion, said positioning portion being pivotally displaceable between first and second positions, said positioning portion being received within said channel in said first position, said positioning portion having a toothed segment formed on a bottom side thereof for engaging said bottom surface teeth of said grasping portion intermediate section when in said first position, whereby said adjusting portion is releasably locked in position relative to said grasping portion; and, (d) a magnet disposed in said intermediate section of said grasping portion.

4. An adjustable wrench comprising:

(a) a grasping portion having front and rear end sections and an intermediate section extending longitudinally therebetween, said front end section having a first wrench engaging surface, said intermediate section including bottom and side surfaces defining a channel having a substantially U-shaped sectional contour, said bottom surface having formed thereon a plurality of teeth;

(b) an adjusting portion slidably coupled to said grasping portion, said adjusting portion having a second wrench engaging surface; and, (c) a positioning portion pivotally coupled to said adjusting portion, said positioning portion being pivotally displaceable between first and second positions, said positioning portion being received within said channel in said first position, said positioning portion having a toothed segment formed on a bottom side thereof for engaging said bottom surface teeth of said grasping portion intermediate section when in said first position, whereby said adjusting portion is releasably locked in position relative to said grasping portion, said positioning portion including a pair of independently displaceable adjacent bodies, said bodies being releasably locked one relative to the other by resiliently biased locking means.

5. The adjustable wrench as recited in claim 4 wherein said resiliently biased locking means includes at least one spring member and a ball disposed within one of said bodies, and a connecting hole formed in the other of said bodies opposing said ball, said ball being spring biased to protrude into said connecting hole when said bodies are substantially aligned one with other.

6. The adjustable wrench as recited in claim 4 wherein said positioning portion has a knife blade formed on a bottom side thereof.

7. The adjustable wrench as recited in claim 4 wherein each of said bodies has a tool coupled to a distal end thereof.

* * * * *